US006560425B1

(12) United States Patent
Lui et al.

(10) Patent No.: US 6,560,425 B1
(45) Date of Patent: May 6, 2003

(54) SHUTTER DEVICE FOR A PHOTOSENSITIVE ROTARY DRUM ON THE PROCESS CARTRIDGE

(75) Inventors: Pui Kuong Lui, Kowloon (HK); Yiu Cheong Law, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 0 days.

(21) Appl. No.: 10/166,011

(22) Filed: Jun. 11, 2002

(51) Int. Cl.[7] ..... G03G 21/18
(52) U.S. Cl. ..... 399/114; 399/111
(58) Field of Search ..... 399/114, 116, 399/117, 26, 207, 155, 13, 113, 111; 355/109

(56) References Cited

U.S. PATENT DOCUMENTS 5,729,796 A * 3/1998 Miura et al. ..... 399/114
5,825,472 A * 10/1998 Araki et al. ..... 399/117

* cited by examiner

*Primary Examiner*—Sophia S. Chen
*Assistant Examiner*—Candice C. Campbell
(74) *Attorney, Agent, or Firm*—Rosenberg, Klein & Lee

(57) ABSTRACT

A shutter device for protecting a photosensitive rotary drum includes a drum cover, at least one torsion spring, a press button, and a compression spring. The drum cover has a fixed end pivotally connected to a predetermined location of a process cartridge, a free end shielded on an exposed portion of said drum and an inside surface formed with a hook, and the torsion spring is arranged on said fixed end of the drum cover. The press button is received in a room of a side of the process cartridge, and the compression spring is positioned between a protruded rod formed inside said press button and a sleeve disposed on said room. Furthermore, the present invention has a better protection for the photosensitive rotary drum, and in the meanwhile, can be as a switch of an exposure window of the process cartridge.

1 Claim, 4 Drawing Sheets

SHUTTER DEVICE FOR A PHOTOSENSITIVE ROTARY DRUM ON THE PROCESS CARTRIDGE

BACKGROUND OF THE INVENTION

1. Field of the Invention

The present invention relates to a shutter device. More specifically, it is mounted on the process cartridge for protecting a photosensitive rotary drum.

2. The Prior Art

There have been known various image forming apparatuses, such as a photographic copying machine, an electro-photographic printer (for example, a LED printer or a laser beam printer), and an electro-photographic facsimile machine, an electro-photographic word processor, and the like.

In the drawing, FIG. 1, which provides a process cartridge 1*a* being removably installed at a predetermined location in the main assembly of the electro-photographic printer. The process cartridge 1*a* comprises four devices: a photosensitive rotary drum 2*a* as an image bearing member, a rotary charge roller 3*a* as a charging member for charging the photosensitive rotary drum 2*a,* a developing device 4*a,* and a cleaning device 5*a,* which are integrally disposed in the cartridge shell, holding a predetermined positional relationship among them.

A referential numeral 20*a* designates a drum cover. It is attached to the underside of the process cartridge 1*a* and covers a bottom of the photosensitive rotary drum 2*a,* so as to protect the photosensitive rotary drum 2*a* when the process cartridge 1*a* is out of the main assembly of the printer. It is moved to a position illustrated in FIG. 1 to expose the bottom of the photosensitive rotary drum 2*a* as the process cartridge 1*a* is installed into the main assembly of the printer. When the process cartridge 1*a* is at the predetermined location in the main assembly of the printer, the exposed bottom portion of the photosensitive rotary drum 2*a* is placed in contact with a transfer roller 10*a,* as a transferring means, on the printer main assembly side, with a predetermined contact pressure, and form a transfer nip for conveying paper.

SUMMARY OF THE INVENTION

It is an object of the present invention to provide a shutter device, which has a better protection for a photosensitive rotary drum, and in the meanwhile, can be as a switch of an exposure window of the process cartridge.

In accordance with one aspect of the present invention, which provides a shutter device for protecting a photosensitive rotary drum, comprising a drum cover, a torsion spring, a press button and a compression spring. The drum cover has a fixed end pivotally connected to a predetermined location of a process cartridge, a free end shielded on an exposed portion of the drum and an inside surface formed with a hook, and the torsion spring is arranged on the fixed end of the drum cover. The press button is received in a room of a side of the process cartridge, and the compression spring is positioned between a protruded rod formed inside the press button and a sleeve disposed on the room of the process cartridge.

BRIEF DESCRIPTION OF THE DRAWINGS

The invention may take physical form in certain parts and arrangement of parts, a preferred embodiment and method of which will be described in detail in this specification and illustrated in the accompanying drawings that form a part hereof, and wherein.

DETAILED DESCRIPTION OF THE PREFERRED EMBODIMENT

Figure 1:
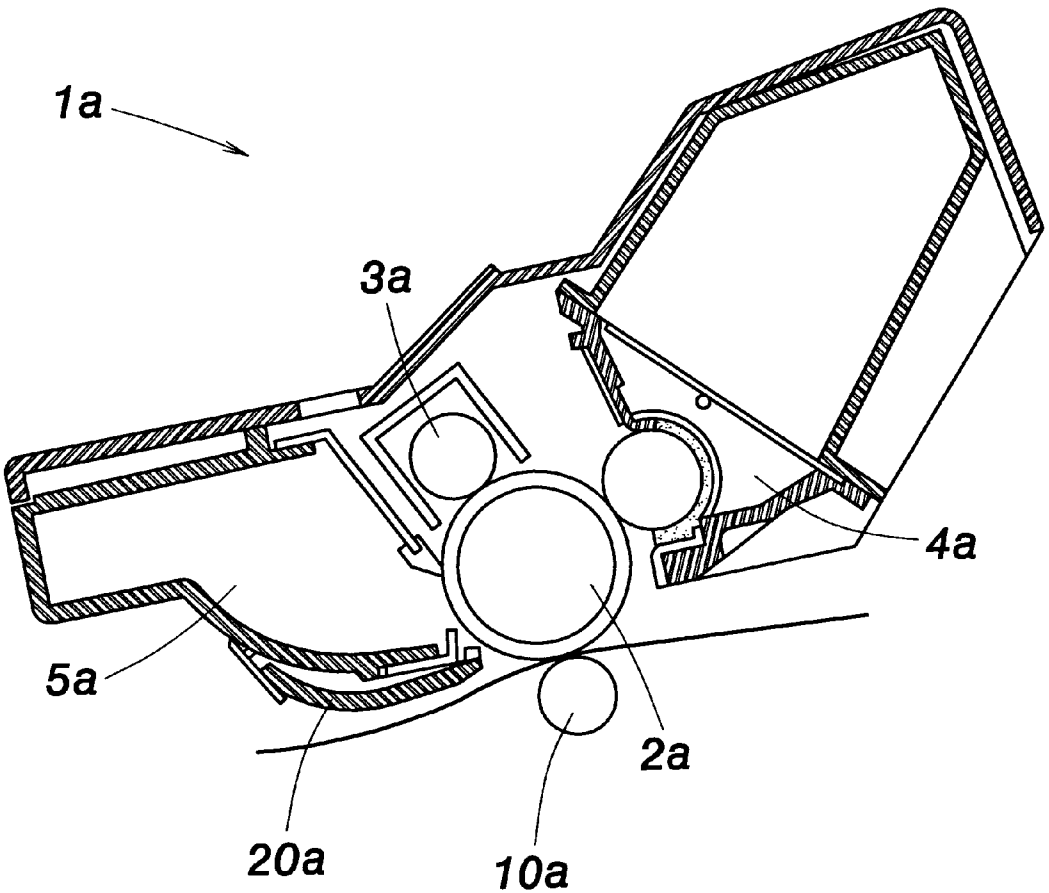
FIG. 1 PRIOR ART
FIG. 1 is a schematic section of an image forming apparatus of prior art.

The present invention will now be described in detail with respect to the accompanying drawings in which like reference numerals designate identical or corresponding parts throughout the several views.

The present invention is applied to a process cartridge being formed in a part of an image forming apparatus, and the image forming apparatus may be an electrophotographic copier, a laser beam printer, a fax machine, or a combination of either or all of these. Furthermore, the process cartridge contains process means for forming an electrophotographic image and in normal use would be replaced by unskilled users. The process means may comprise a magnetic brush system for transporting mono- or dual component developer from locations in one or more hoppers to a developing station whereby the developer and/or toner is presented to a latent image on the photosensitive drum.

Figure 2:
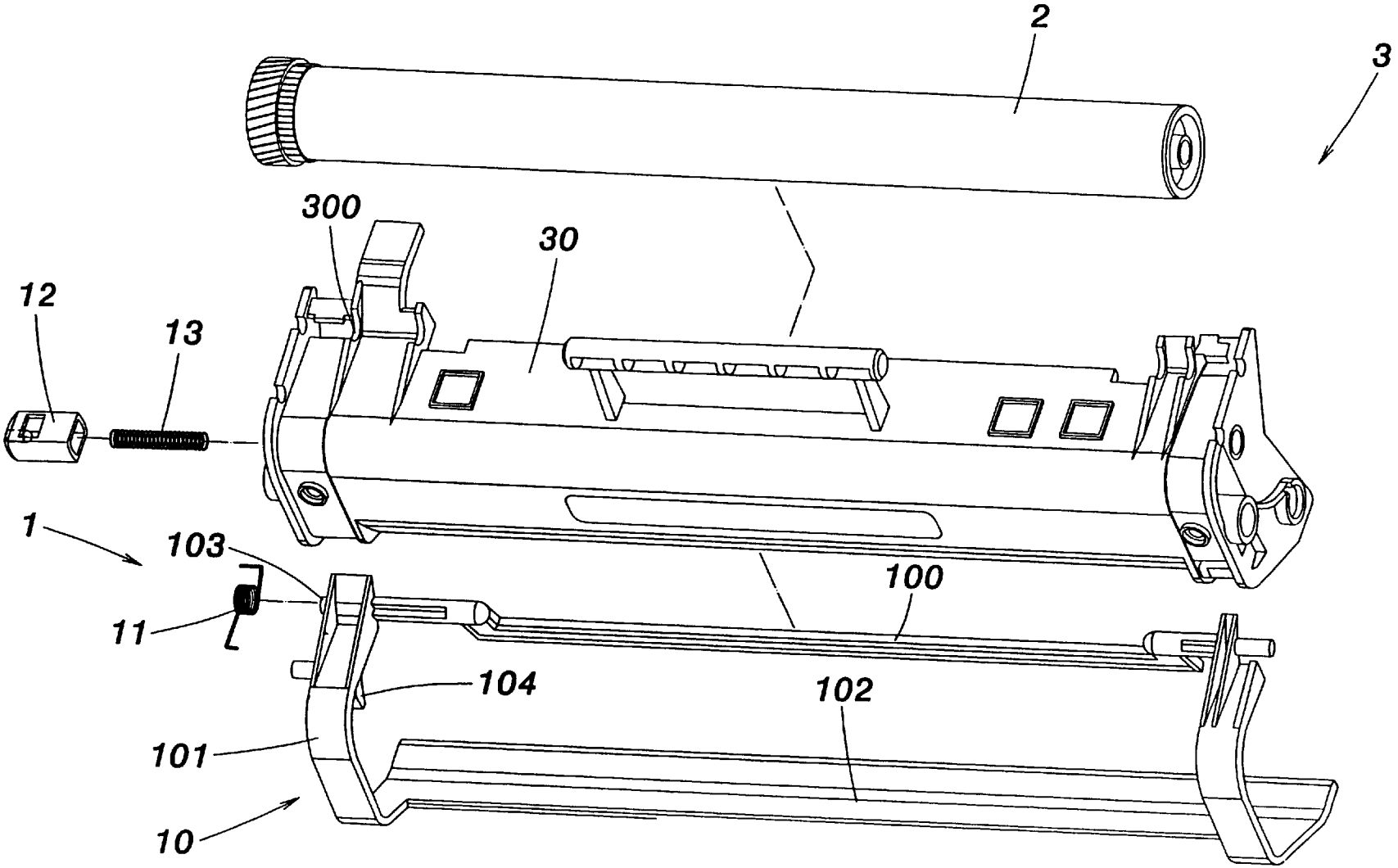
FIG. 2 is an exploded view of the present invention.

Next, please refer to FIG. 2, the present invention provides a shutter device 1 for protecting a photosensitive rotary drum 2, which comprises a drum cover 10, at least one torsion spring 11, a press button 12, and a compression spring 13. The drum cover 10 has two sidepieces 101 each formed as an arc-like shape, a pivotal member 100 having two sides coupled to respective fixed ends of two sidepieces 101, a cover piece 102 having two sides integrally formed with respective free ends of two sidepieces 101. The pivotal member 100 has two pivotal rods 103 protruded at two sides thereof, so as to be respectively pivotally connected to at least two pivotal holes 300 of a scavenger casing 30 of a process cartridge 3, and the cover piece 102 is shielded on an exposed portion of the photosensitive rotary drum 2.

Furthermore, one of the sidepieces 101 of the drum cover 10 has an inside surface formed with a hook 104, and the torsion spring 11 is arranged on the pivotal rod 103 of the fixed end of the drum cover 10. The press button 12 is received into a room 301 formed in a side of the scavenger casing 30, and the compression spring 13 is positioned between a protruded rod 120 formed inside the press button 12 and a sleeve 302 disposed on the room 301 of scavenger casing 30, and the press button 12 has an opening 121 formed at a top portion thereof for being correspondingly matched with the hook 104 of the drum cover 10, so as to fasten the drum cover 10 and the scavenger casing 30 together.

Figure 3:
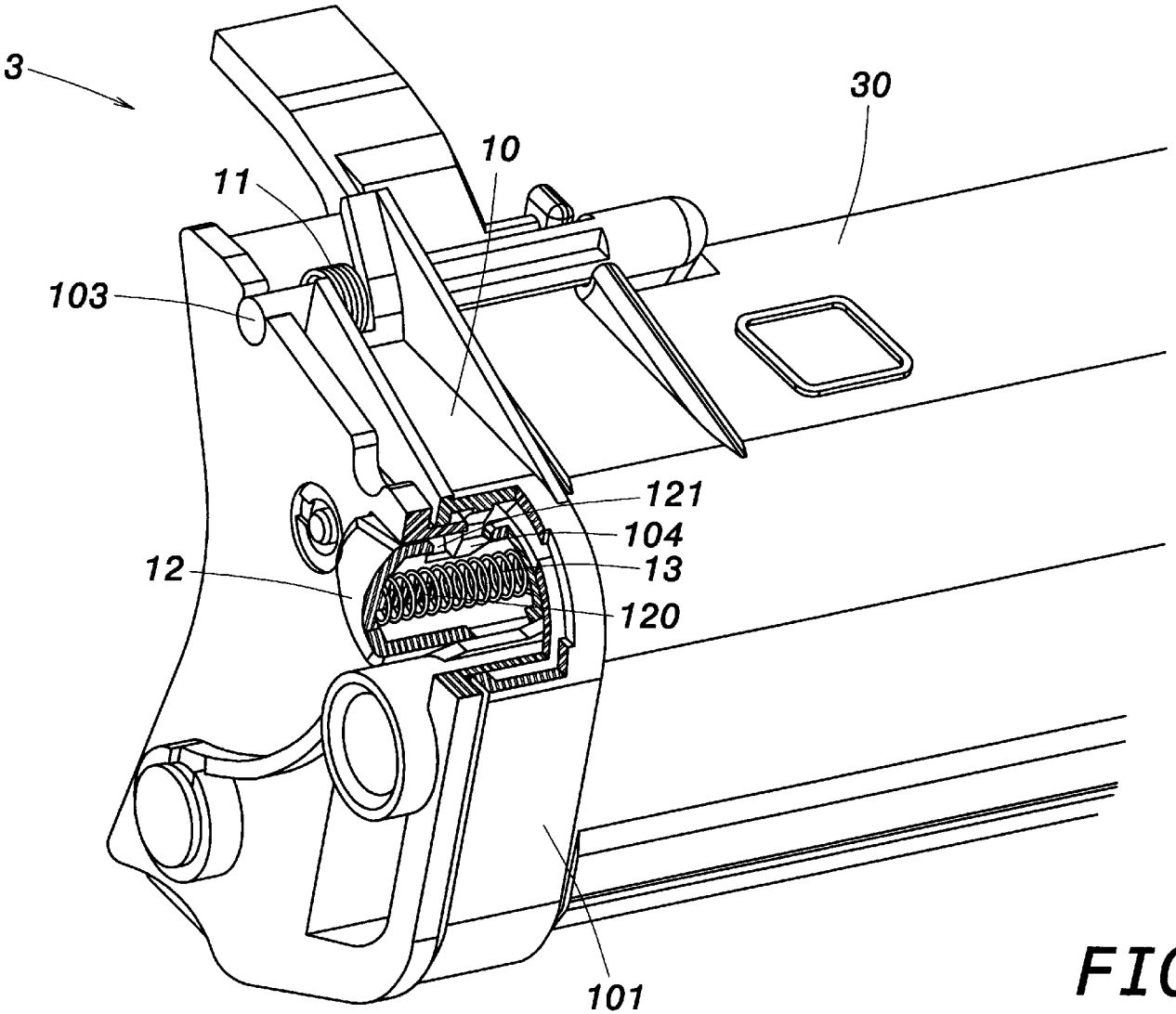
FIG. 3 is a partial perspective view of the present invention when the cover drum is closed.
Figure 4:
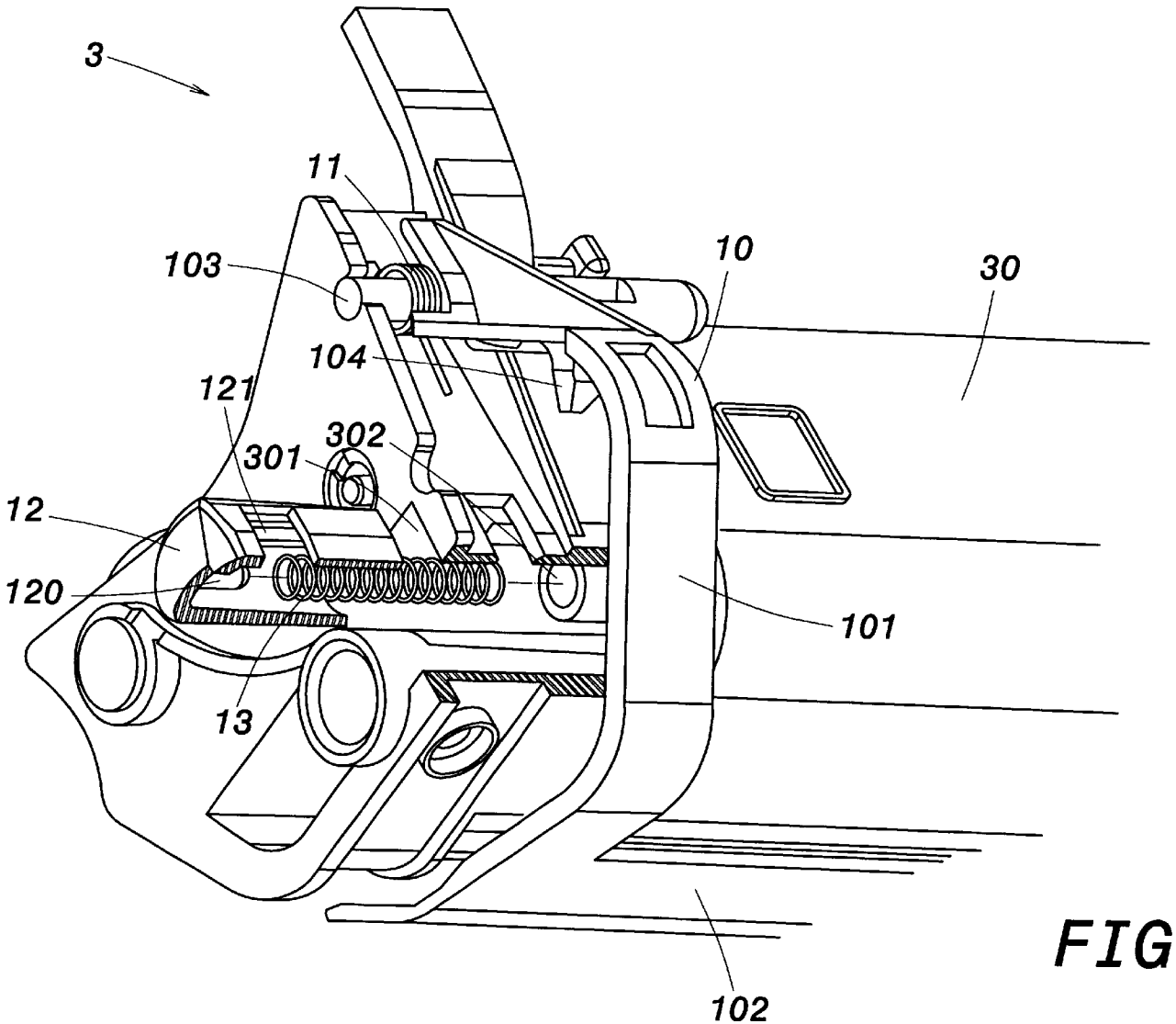
FIG. 4 is a partial perspective view of the present invention when the cover drum is opened.

In the operation, please refer to FIG. 3, when the press button 12 is pressed into the room 301 of the scavenger casing 30 of the process cartridge 3, the hook 104 of the drum cover 10 can pass through the opening 121 of the press button 12, thereby to be fixedly positioned on a portion of said press button 12 by an opposite elasticity of the compression spring 13. Then, in FIG. 4, when the press button 12 is again pressed toward the room 301 of the scavenger casing 30 of the process cartridge 3, the hook 104 of the drum cover 10 can be separated from the opening 121 of the press button 12 by an opposite elasticity of the torsion spring 11.

Furthermore, as the drum cover 10 is opened by manual operation or automatic machine, a laser beam (not shown) is deflected by mirror and enters the main assembly of the process cartridge 3 through an exposure window (not shown) of the process cartridge 3, scanning the peripheral surface of the photosensitive rotary drum 2, which has been charged by the charge roller. As a result, the drum cover 10 can be as a switch of the exposure window of the process cartridge 3.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A shutter device for protecting a photosensitive rotary drum, comprising:

a drum cover having a fixed end pivotally connected to a predetermined location of a process cartridge, said drum cover having a portion thereof shielding an exposed portion of said photosensitive rotary drum, an inside surface of said drum cover having a hook formed thereon and at least one torsion spring being arranged on said fixed end of said drum cover; and a press button being received in a room of a side of said process cartridge and a compression spring being positioned between a protruded rod formed inside said press button and a sleeve disposed on said room of said process cartridge, said press button having an opening formed in a top portion thereof for being correspondingly matched with said hook of said drum cover, wherein said hook of said drum cover is fixedly positioned in said opening of said press button when said press button is pressed into said room of said side of said process cartridge.

* * * * *